United States Patent [19]

Virk et al.

[11] 4,359,863

[45] Nov. 23, 1982

[54] EXHAUST GAS TORCH APPARATUS

[75] Inventors: Kashmir S. Virk, Hopewell Junction; Robert B. Burns, Huntington, both of N.Y.

[73] Assignee: Texaco Inc., White Plains, N.Y.

[21] Appl. No.: 218,608

[22] Filed: Dec. 22, 1980

[51] Int. Cl.[3] ..... F01N 3/02

[52] U.S. Cl. ..... 60/297; 55/DIG. 30; 55/269; 60/298; 60/300; 60/303; 422/169; 422/173; 422/174; 422/182; 422/183

[58] Field of Search ..... 60/274, 286, 297, 298, 60/300, 303, 284; 422/169, 174, 173, 182, 183; 55/DIG. 30, 269

[56] References Cited

U.S. PATENT DOCUMENTS

| | | | |
|---|---|---|---|
| 2,898,202 | 8/1959 | Houdry | 60/300 |
| 2,946,651 | 7/1960 | Houdry | 60/296 |
| 3,306,035 | 2/1967 | Morrell | 60/303 |
| 3,503,716 | 3/1970 | Berger | 60/297 |
| 3,557,536 | 1/1971 | Ririe | 55/269 |
| 4,322,387 | 3/1982 | Virk | 422/172 |

*Primary Examiner*—Douglas Hart
*Attorney, Agent, or Firm*—Carl G. Ries; Robert A. Kulason; Robert B. Burns

[57] ABSTRACT

Apparatus for filtering combustible particles from an exhaust gas stream, and for periodically rejuvenating the filter bed and catalyst section thereof, by incinerating retained particles. At least a portion of an engine's exhaust gas stream is initially preheated for the purpose of raising the catalyst to a predetermined "lightoff" temperature. A small amount of a supplementary fuel is brought into heat exchange contact with portions of the filter interior or exterior to elevate this fuel to a suitable temperature. The heated supplementary fuel is then intermixed with the exhaust gas stream prior to the latter entering the catalyst section, thereby causing the fuel/gas mixture to react. Subsequent to initiation of the oxidation reaction, further preheating energy input to increase the exhaust gas to "lightoff" temperature, can be discontinued without affecting the combustible particle incineration rate.

9 Claims, 3 Drawing Figures

FIG. 1
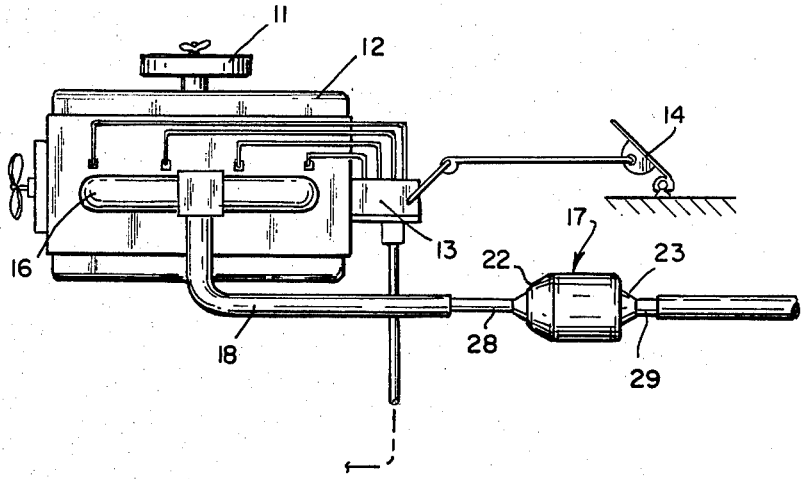
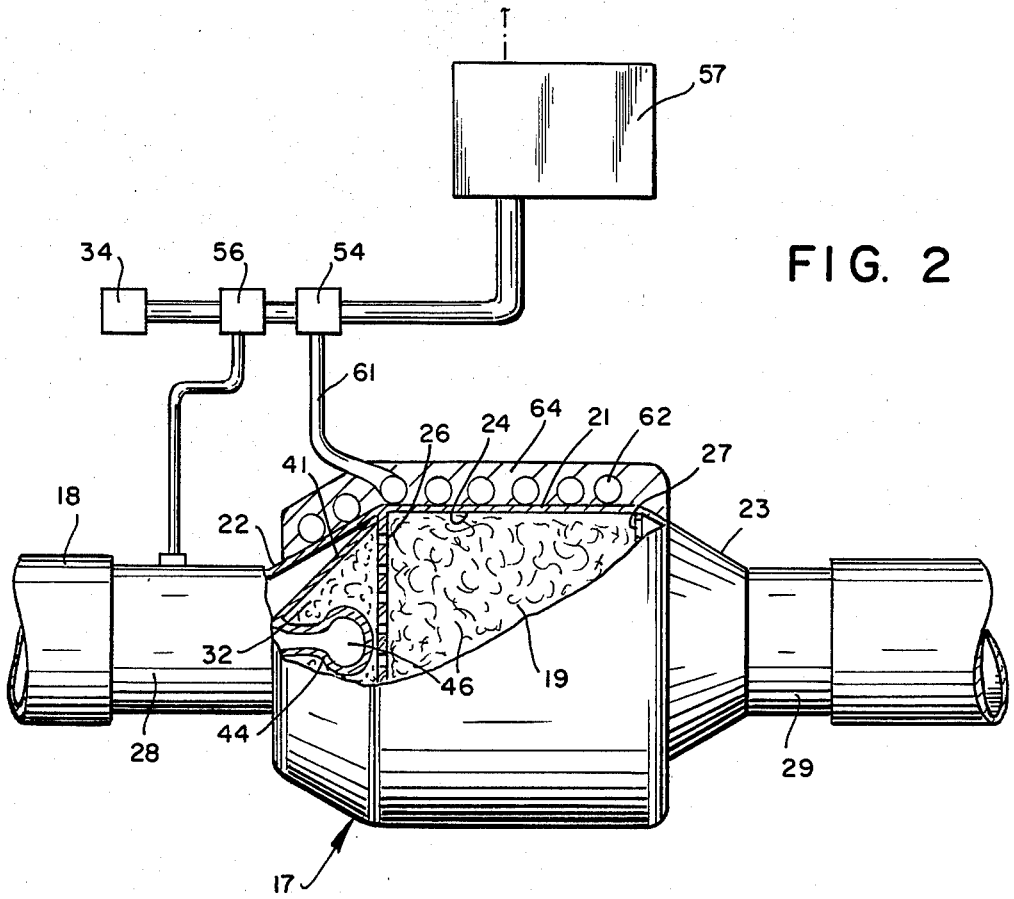
FIG. 2

EXHAUST GAS TORCH APPARATUS

BACKGROUND OF THE INVENTION

With any internal combustion engine it is desirable to treat exhaust gases so that they can be safely discharged into the atmosphere. In some engines, particularly of the diesel type, among the most prevalent operating problems is the presence of particulates which are carried in the exhaust gas stream.

Primarily, the particulates are normally bits of carbon. They result from incomplete combustion of the hydrocarbon fuel under certain engine operating conditions. However, the operating efficiency of the engine is also a contributing factor to the amount of carbon produced.

The presence of relatively large amounts of carbon particles in any exhaust gas stream is evidenced by a dark, smoky, undesirable effluent. Such smoke is not only offensive aesthetically; in large quantities it can be unhealthy.

Means have been provided and are known to the prior art, for the elimination or minimization of the particulate content in exhaust discharge streams. However, it has been found that while the particulates can be eliminated by a suitable filter of proper construction, eventually the latter can become saturated and/or inoperable due to excessive particulate accumulations.

It is further known that the overall engine exhaust gas treating process can be expedited. This is achieved not only by passing the hot gas stream through a filter medium, but by providing the filter with a catalyst which will promote combustion of retained particles.

It should be appreciated that the generation of carbon particles is prevalent under all diesel engine operating conditions. It is further appreciated that the quantity and quality of an exhaust gas stream created in any internal combustion engine will vary in accordance with the operating characteristics of the engine.

For example, the temperature range experienced by a diesel exhaust gas stream can vary between slightly above ambient air temperature, and temperatures in excess of 1200° F. When the exhaust gas is hot enough, carbon particles trapped in a filter will be combusted. However, engine operating conditions at which this rejuvenation can occur is not always attainable in diesel passenger cars, buses or the like.

Where it is found that an engine continuously operates under such circumstances that particulates are continuously produced and accumulated in the filter, the particulate trapping filter bed must be rejuvenated with a degree of consistency.

When the exhaust is sufficiently hot, rejuvenation will consist of merely introducing the hot exhaust gas stream, containing sufficient oxygen, into the filter bed to contact and incinerate retained carbon particles. The combustion of any large, contained carbon accumulation can however, produce temperatures in excess of that of the exhaust gas. The result is that at such excessive temperatures, the filter bed is susceptible to thermal shock, damage or distortion.

Toward achieving an improved and controlled rate of carbon removal from an exhaust gas stream without incurring damage to the filter, the unit presently disclosed is provided.

The instant system thus constitutes in brief, a reaction chamber or filter bed which comprises in part a catalytic segment or section through which the exhaust gas stream flows. This catalytic surface can be incorporated within the particle trapping bed, or can be disposed at the upstream end thereof.

To assure that the main filter bed remains functional in spite of engine operating conditions, a portion of the exhaust gas stream is periodically preheated within an electrically powered heating zone.

This stream is passed into contact with the catalytic segment, thereby raising the temperature of a part of the catalyst segment to the catalyst "lightoff" temperature.

Supplementary fuel is preheated by being brought into contact with a hot surface or surfaces of the filter. The heated fuel is then injected into the heated portion of the exhaust gas to form a fuel/exhaust gas mixture. When the latter mixture contacts the heated catalyst, it will ignite. When the oxidizing action within the catalyst section becomes self-sustaining, the initial electrical heating of the exhaust gas stream can be discontinued.

In summary, the main filter bed will be regularly and at periodic intervals, purged or rejuvenated by hot exhaust gas from the catalyst section. Such treatment, if repeated at predetermined times will preclude carbon accumulations which, if not disposed of, might otherwise lead to thermal stress or damage to the filter bed at such time as the accumulation is combusted.

It is therefore an object of the invention to provide a filter of the type disclosed which is capable of retaining combustible particulates from an exhaust gas stream, and of being periodically rejuvenated by incinerating the particulates.

A further object is to provide a particulate filter of the type disclosed which is capable of removing solid combustible elements from an exhaust gas stream while permitting periodic rejuvenation of the filter element.

A still further object is to provide a filter unit for an internal combustion engine, which filter is periodically rejuvenated by supplemental heating means and by introduction of a preheated flow of fuel to the filter bed while the engine is operating at conditions that do not ordinarily result in exhaust gas temperatures sufficiently high to initiate combustion of the supplementary fuel.

DESCRIPTION OF THE DRAWINGS

FIG. 1 illustrates a diesel engine of the type contemplated with which the present smoke filtering system cooperates.

FIG. 2 is an enlarged view in cross-section, of the filter element shown of FIG. 1.

Referring to FIG. 1, to facilitate description of the present system, an internal combustion engine 10 or other source of exhaust gas, will be considered to be of the diesel type. In the latter, air is sequentially introduced from an air filter 11, by way of manifold 12 to the various combustion chambers.

Figure 3:
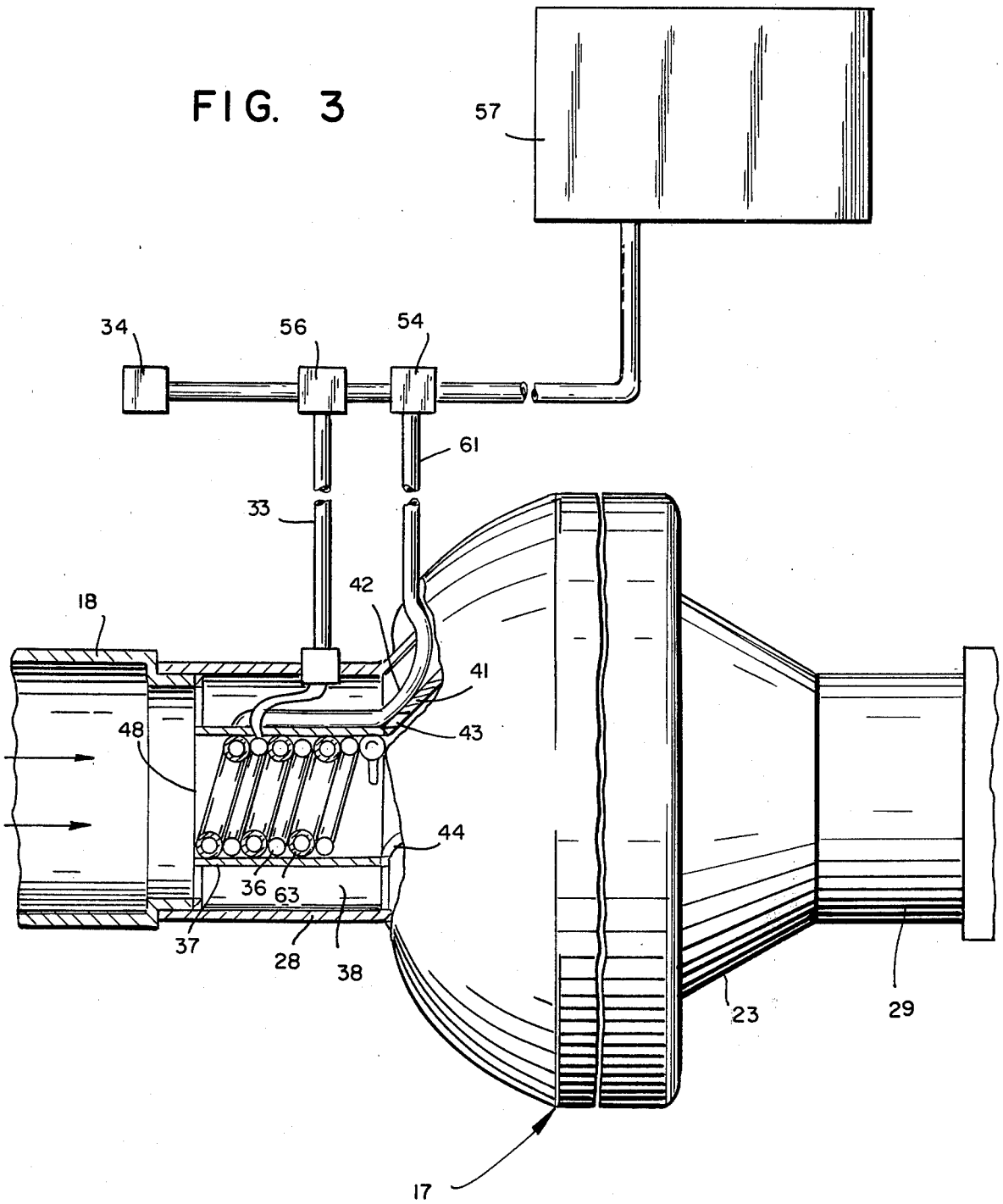
FIG. 3 is an enlarged elevation view of the present filter with a section shown broken away.

Diesel fuel is thereafter injected in controlled amounts into each combustion chamber from a fuel pump 13. Fuel flow rate is regulated by control linkage 14.

The hot exhaust gas stream is led from exhaust manifold 16, and conducted through an exhaust pipe 18 to a smoke filter 17. Although a sound absorbing muffler could be inserted into the exhaust pipe, such an element is ancillary to and not essential to the instant system and method of operation.

The exhaust gas stream, subsequent to leaving exhaust manifold 16, will usually be at a temperature within the range of about 200° to 1200° F. The precise temperature will depend on the operating conditions of the engine.

For example, at low and idle speeds, exhaust gas will be relatively cool or only moderately heated. Consequently, as the particle laden exhaust gas stream enters filter 17, the particulates will be retained along the many diverse passages within the filter bed 19.

While the exhaust gas is comprised primarily of a combination of gases, it usually embodies sufficient oxygen content to support at least a limited degree of combustion within the stream itself.

Referring to FIG. 2, in one embodiment, filter 17 comprises an elongated metallic casing 21 having opposed end walls 22 and 23 which define an internal reaction chamber 24. The latter chamber is occupied to a large extent by at least one filter bed 19, formed of material particularly adapted to provide a plurality of irregular flow passages therethrough.

The function of bed 19 is to define a series of passages along which the exhaust gas will flow. During such passage, particulate matter carried on the exhaust stream will be retained on the various passage walls.

Bed 19 can be formed preferably of a metallic mesh-like mass such as steel wool, metal fibrils or the like, which mass is shaped to substantially fill reaction chamber 24.

Bed 19 is preferably supported at its upstream and downstream ends by perforate panels 26 and 27, screens, or other similar rigid, gas permeable transverse members. The latter are positioned at casing 21 wall to support the one or more beds 19 therein particularly when the latter become weakened from heat.

The filter upstream wall 22 is provided with inlet port 28 for preheating and then introducing exhaust gas to the upstream side of bed 19. In a similar manner wall 23 is communicated with a discharge conduit 29 to carry away particle-free gases which leave bed 19.

To best achieve the gas filtering action, bed 19 can be comprised as noted of a suitable gas pervious medium or matrix which is capable of retaining solid particulate matter from the exhaust gas stream. To facilitate the incineration of the retained particles, heated exhaust gas entering the filter will initially heat the catalyst containing conical segment 32 thereof by contact. With catalyst portion 32 then raised to "lightoff" temperature, supplementary fuel can be added to the heated exhaust to form a combustible fuel/gas mixture.

A part of the catalyst bed 32 now at a temperature of about 450° to 550° F., will receive the fuel/gas mix. The fuel component, whether in liquid or gaseous form, together with the combustion supporting oxygen in the exhaust stream, will thereby be ignited when contacted with the hot catalyst surface.

At such time as the fuel mixture commences to burn, the catalyst bed 32 will no longer require preheating energy. As the combustion of the fuel/gas mixture continues in bed 19, the latter will gradually rise to about 1000° to 1300° F.

As the heated exhaust gas stream enters main filter bed 19 from catalyst segment 32, the gas will be at an elevated temperature approximating that of the catalyst bed. In such an elevated temperature environment, particulate matter which has been retained on the main filter will be incinerated, and bed 19 will be left relatively particle-free.

A preferred embodiment of the apparatus provides that the forward or upstream end of filter bed 19 be contiguous with catalyst segment 32. The latter includes a matrix or filter media having a thin layer of an oxidizing catalyst material deposited on the surface.

Although not presently shown, catalyst segment 32 can be spaced from and upstream of filter bed 19, although not at such a distance that exhaust gas will experience cooling before it reaches bed 19.

In the present embodiment, as noted, catalyst segment 32 is positioned in the forward or upstream portion of casing 21. It extends transversely of the latter to contact substantially the entire hot exhaust gas stream.

Toward achieving the preheating of at least a portion of the exhaust gas stream, filter inlet 28 is provided with an electrically energized heater 36. Also included in said exhaust gas preheat section, is a supplemental fuel injector means system. The latter embodies a fuel line 61 section to carry a flow of supplemental fuel for heating the latter prior to its being injected into the heated exhaust gas stream.

Referring to FIG. 3, inlet port 28 of filter 17 is comprised of a generally elongated tubular conduit which connects to, and defines a continuation to the end wall 22. A second or inner conduit 37 is disposed internally of said conduit 28 to define an annular passage 38 therebetween through which a major portion of the exhaust gas stream flows.

While both members, 28 and 37, are disclosed as being tubular, the exact shape or cross sectional contour thereof is of relatively little consequence since it is only necessary that the respective passages conduct the divided exhaust gas stream toward catalyst bed 32.

Second conduit 37 is supported at its opposed ends by a transverse cage 39 at the forward end which is fixed at its periphery to the inner wall of conduit 28. The conduit 37 downstream end is supported by a generally conically shaped gas deflector 41, the latter being joined about its peripheral rim to the inner wall of casing 21.

Deflector 41 defines a progressively contracting passage 42 with the adjacent filter end wall 22. A series of longitudinally and peripherally spaced openings 43 permit untreated exhaust gas which flows through annular passage 38, to be progressively introduced to the catalytic segment 32.

The downstream end of inner tubular member 37 is communicated with a gas diffuser 44. The latter includes a central chamber 46 defined by an outer wall into which a series of discharge openings 47 are formed. Chamber 46 is positioned to receive the heated flow of fuel/exhaust gas mixture, and to discharge said mixture radially by way of openings 47, into catalytic bed 32. At the latter, the fuel/gas mixture upon contacting the catalyst surface will immediately ignite if the surface temperature is at, or in excess of the "lightoff" temperature.

Heater element 36 is disposed within inlet 28, having a generally circular cross section, and positioned to contact at least a small or minor portion of the exhaust gas stream issuing from conduit 18. In the embodiment here illustrated, heater 36 comprises an elongated strip-like member which is conformed to define a substantially cylindrical passage 48 therethrough.

Heater element 36 can alternatively be formed to define a spiral-like configuration through which a portion of the exhaust gas flows whereby the latter will be heated as a result of contact with the guiding heater walls.

In the shown arrangement, heater 36 extends longitudinally of inlet conduit 28 and is preferably coaxial thereto. In either instance, the exhaust gas stream which enters the upstream end of inlet 28 will be bifurcated. The major port of the flow passes into annular passage 38. A minor portion will enter internal passage 48 defined by the heater.

Heater 36 in one embodiment, and as shown in FIG. 3, lies contiguous with the inner walls of second tubular conduit 37. The latter will thereby cause radiating energy to be deflected inwardly, the more effectively to heat the gaseous stream flowing toward diffuser 44, as well as heating the supplemental fuel. In one embodiment, and toward confining the gaseous stream, adjacent coils of heater 36 can be wound sufficiently close to define a substantially closed central passage 48.

Functionally, the major flow of exhaust gas, comprising about 90 to 99 percent by volume, and which enters annular passage 38 from pipe 18, will flow into constricted passage 42 and thence through openings 43 of deflector 41. The gas will thereafter enter catalyst bed 32.

In the latter, this unheated gas segment will be reunited with the minor, heated gas flow thereby to stabilize or lower the temperature of the latter. The minor gas flow can comprise between about 1 to 10 percent by volume of the entire exhaust gas stream.

While heater 36 is here illustrated as being a single, spirally wound electrical element, the specific form thereof can assume any one of a number of shapes or configurations. Further, even though the present embodiment of the heater unit defines a substantially constant cross sectional passage 48, such a configuration is not essential but rather is effective.

For example, and as mentioned, heater 36 can be shaped to define a gradually decreasing cross sectional passage. Further it can extend longitudinally of second conduit 37 to define heated walls against which the exhaust gas stream flows. In any instance, it is cooperatively arranged with diffuser 44 to deliver a hot gas stream to the latter for further dissemination.

Heater 36 is actuated between on and off conditions through an appropriate connection 33. The latter is connected through the wall of conduit 28, to a timing controller 56, and thence to an electrical energy source 34.

The downstream end of passage 48 is provided with fuel injection means adapted to introduce a controlled flow of heated liquid or gaseous fuel into the exhaust gas stream. At least one injector 51 is disposed adjacent to diffuser 44 inlet, being communicated with a fuel preheating heat exchange means and having a nozzle 52 which terminates in central passage 48. Fuel injector 51 traverses the wall of the inlet conduit 28 and is connected therewith at a terminal 53. The latter is communicated in turn to a source 57 of the supplementary fuel.

The fuel utilized for heating exhaust gas can comprise a suitable fluid such as diesel oil, kerosene or in the instance of a gaseous fuel, propane. Further, virtually any fluid which is capable of forming the desired fuel-/exhaust gas mixture capable of being controllably burned, can be utilized in the present instance.

The supplementary fuel circuit, external to the filter, includes a pump 54 or similar member which is capable of metering the necessary controlled fuel stream to injectors 51. Timing or metering mechanism 56 functions to periodically actuate the pump. Thus, the filter purging cycle can be programmed to permit injection of a predetermined amount of supplementary fuel into the exhaust gas at desired time intervals.

The amount of electrical energy which is utilized by heater 36 to preheat part of the exhaust gas stream is preferably minimized. However, supplementary fuel tank 57 will ordinarily be exposed to the environment and consequently the contained fuel will vary within a wide temperature range.

During periods of cold weather exposure, the supplementary fuel can reach rather low temperatures. Thus, when it is injected into the heated exhaust gas stream it will tend to unduly cool the latter and thereby lengthen the preheating period or chill catalyst bed 32.

To avoid or minimize the degree of such cooling, the supplementary fuel supply is initially brought into heat exchange contact with the filter 17 itself. Preferably, heat energy which is normally radiated from the filter body is used to elevate supplementary fuel to a desired temperature. In addition, said fuel can be brought into proximity of heater 36 to be indirectly heated by contact with the latter.

As shown in FIG. 2, supplementary fuel from tank 57 after leaving pump 54 is passed through a heat exchange bank or coil 62 by way of line 61. Coil 62 is preferably disposed in direct contact with the outer wall of casing 21 to receive the full benefit of any heat which is radiated from the latter.

Heat exchange coil 62 can comprise one or more lengths of tubing which are passed longitudinally along the casing 21. Alternatively, the heat exchange arrangement can comprise a single coil which as shown, wrapped about and in contact with the said casing 21 wall. In either instance, to minimize heat loss to the atmosphere, the entire filter 21, or merely the heat exchange coil 62, can be lagged or otherwise provided with an insulating layer 64.

Referring to FIG. 3, after the initially preheated fuel is conducted into the filter interior, or even prior to being preheated, in coil 62, it is passed through a second heat exchange coil or bank 63. The latter is disposed in direct contact with the heater 36.

Second heat exchange bank 63 can be comprised of a coil which is wound concurrently with the coils of heater 36 and in line contact with the latter. Alternatively, second heat exchange bank 63 can be passed longitudinally along passage 48 to be in point contact with the respective heater coils.

In either event, after the heated supplementary fuel has traversed heating bank 63, it is passed into fuel nozzle 52. The heated fuel stream then enters the passing exhaust gas stream to form a fuel/gas mixture.

This preheating of supplementary fuel prior to the latter entering the exhaust gas stream serves to maintain the temperature of the exhaust gas as the latter leaves heating passage 48. Thereafter as the fuel/gas mixture enters diverter 44, it will be at a desired lightoff temperature of the catalyst bed 32 so that the mixture can be safely passed radially outward into the catalyst section 32.

Operationally, the filter purging cycle commences in response to action of timing mechanism 56 which activates heater 36. The exhaust gas stream flowing from conduit 18 will be divided, a portion thereof will enter passage 48 defined by heater 36, and be further heated.

This exhaust gas preheating step will continue so long as is required, to bring the temperature of the exhaust gas at the downstream end of heater 36, to a predetermined level prior to introduction of the gas mixture to catalyst bed 32.

Since the catalyst bed surrounding diffuser 44 will have to be elevated to lightoff temperature of approximately 550° F., initial heating of the gas flow at heater 36 will continue until such a condition is reached within catalyst bed 32.

Maintenance of the exhaust gas preheating period can be established on a programmed timed cycle. Alternately it can occur in response to a temperature rise within catalyst bed 32 as determined by a suitable sensor or thermocouple which can be positioned within bed 19 and is connected to timing or control mechanism 56.

When catalyst bed 32 has been elevated to the desired temperature level, control means 56 will initiate supplementary fuel flow through pump 54 and into fuel heating circuit. After passing through coil 62 and/or 63, the fuel will enter the heated exhaust gas stream to form a combustible fuel/exhaust gas mixture upon entry thereof into diffuser section 46.

From the latter the fuel/exhaust gas mixture is introduced by way of discharge opening 47 to catalyst bed 32 where it immediately ignites. The resulting burning will progressively raise the temperature of filter bed 19 to a level at which retained particles will be combusted.

Other modifications and variations of the invention as hereinbefore set forth can be made without departing from the spirit and scope thereof, and therefore, only such limitations should be imposed as are indicated in the appended claims.

We claim:

1. Filter for treating the exhaust gas stream from an internal combustion engine, which stream carries combustible particulate matter therewith, said filter including;

a casing 21 defining an elongated reaction chamber 24 which includes a filter media, and having a discharge conduit 29 and an elongated inlet port 28, the latter being adapted to communicate with a source of said exhaust gas, a catalyst bed 32 disposed at the upstream end of said reaction chamber 24 to receive exhaust gas which flows through said inlet port 28, a heater element 36 positioned in said inlet port 28 to contact at least a portion of the exhaust gas stream which flows through the latter, injector means including a fuel line communicated with a source of fuel, and being disposed in heat exchange contact with heated portions of said filter whereby to preheat fuel which passes therethrough, and nozzle means at the end of said fuel line which opens into said inlet port whereby to introduce a flow of heated fuel into the said at least a portion of said exhaust gas stream.

2. In the filter as defined in claim 1, wherein said fuel line is disposed in heat exchange contact with a portion of the filter casing external wall.

3. In the filter as defined in claim 2, wherein said fuel line includes; an insulating medium disposed thereon.

4. In the filter as defined in claim 1, wherein said fuel line includes; a portion thereof disposed internally of the casing aligned contiguous with said heater element.

5. In the filter as defined in claim 1, wherein said fuel line includes; an internal portion thereof disposed in a passage lying longitudinally of said inlet port.

6. In the filter as defined in claim 4, wherein said fuel line internal portion is disposed in heat exchange contact with said heater element 36.

7. In the filter as defined in claim 5, wherein said nozzle means includes; at least one nozzle which opens into said passage 48.

8. In the filter as defined in claim 5, wherein said nozzle means includes; a nozzle opening disposed at a point adjacent to the heater downstream end.

9. In the filter as defined in claim 5, wherein said fuel line is disposed externally of said casing in heat exchange contact therewith, and a subsequent portion disposed internally of the casing in communication with said heater element.

* * * * *